US007648029B2

(12) United States Patent
Chen

(10) Patent No.: US 7,648,029 B2
(45) Date of Patent: Jan. 19, 2010

(54) SIMPLIFIED ROTATABLE ANTI-THEFT TOOL RACK

(76) Inventor: Terence Chen, No. 229, Lane 352, Sec. 2, Luhe Rd., Lugang Town, Changhua County (TW)

( * ) Notice: Subject to any disclaimer, the term of this patent is extended or adjusted under 35 U.S.C. 154(b) by 180 days.

(21) Appl. No.: 11/808,201

(22) Filed: Jun. 7, 2007

(65) Prior Publication Data

US 2008/0302743 A1 Dec. 11, 2008

(51) Int. Cl.
*B65D 75/56* (2006.01)

(52) U.S. Cl. ..... 206/376; 206/806; 211/70.6

(58) Field of Classification Search ..... 206/349, 206/376, 377, 378, 806; 211/70.6, 113, 115; 248/309.1

See application file for complete search history.

(56) References Cited

U.S. PATENT DOCUMENTS 6,637,606 B1 * 10/2003 Chen ..... 211/70.6
6,827,210 B2 * 12/2004 Chen ..... 206/349
2002/0162763 A1 * 11/2002 Chow ..... 206/349
2002/0175257 A1 * 11/2002 Yen ..... 248/309.1
2004/0089620 A1 * 5/2004 Chen ..... 211/70.6
2004/0094444 A1 * 5/2004 Chen ..... 206/376
2006/0086636 A1 4/2006 Kuo

FOREIGN PATENT DOCUMENTS

EP 1652789 5/2006
EP 1741639 1/2007

* cited by examiner

*Primary Examiner*—Luan K Bui
(74) *Attorney, Agent, or Firm*—Rosenberger, Klein & Lee

(57) ABSTRACT

A simplified rotatable anti-theft tool rack comprises a tool rack body and an inserting body that cooperate with each other to position a tool. The tool rack body includes a limiting portion used to receive an inserting portion of the head of the tool and connected with a guiding portion. At the end of the guiding portion is disposed with a fastening portion for restricting the tool by cooperating with a fixing element. The inserting body includes a multangular engaging portion. One end of the engaging portion is disposed with a stopping flange, and the other end of the engaging portion is extended to form a neck-shaped inserting portion. At the end of the inserting portion which has inserted through the limiting portion is formed a big-diameter check portion, thus forming a simplified structure, achieving the anti-theft and rotatable effect.

10 Claims, 11 Drawing Sheets

SIMPLIFIED ROTATABLE ANTI-THEFT TOOL RACK

BACKGROUND OF THE INVENTION

1. Field of the Invention

The present invention relates to a simplified rotatable anti-theft tool rack suitable for a tool with a closed head. It utilizes the integral inserting body to insert into the receiving portion of the head of the tool and then directly assemble the tool on the tool rack through a simplified structure, so as to achieve the objectives of safe anti-theft, high safety and quick & easy operation.

2. Description of the Prior Art

The existing tool hanging display structures are various, they have different structures and different functions, and a lot of tool racks or display structures or anti-theft structures designed for the tools with an enclosed head have obtained the patent, for instance:

Wrench Suspension Board disclosed by TW Patent No. 86304252 uses a fastening strap as an anti-theft device, so that the anti-theft effect is rather limited and it is easy to damage the strap from outside, thus improvement is necessary.

A tool rack disclosed by Patent No. 89215602 comprises a rotatable element and a sounding element which are disposed on a rack body. The tool can be positioned on the rack body by cooperating with the rotatable element and the sounding board, the rotatable element is formed with a furcated elastic structure corresponding to the sounding plate or the end of the tool rack, although such a structure has a reverse hook for positioning the tools, the hook can be pulled out or pushed back by force, so that the tools can be taken away and accordingly the anti-theft effect is not good. Furthermore, the integral structure is comparatively complicated; in order to produce sound, between the sounding plate and the tool rack body is arranged a tooth type sound generating device which causes the interspace between the tool rack body and the sounding plate & the tool to be positioned and also causes unnecessary loose of the integral structure.

The present invention has arisen to mitigate and/or obviate the afore-described disadvantages.

SUMMARY OF THE INVENTION

The primary objective of the present invention is to provide a simplified rotatable anti-theft tool rack capable of achieving the anti-theft effect and simplifying the assembly process.

To achieve the abovementioned objectives, the simplified rotatable anti-theft tool rack utilizes the integral inserting body and the relatively simplified tool rack body to safely combine the tool head with the tool rack after the inserting body is engaged with tool head and then has relatively large check force. Thereby, there is not any elastic returning structure to reduce the anti-theft effect of the tool rack, thus achieving the objectives of assuring the anti-theft performance and simplified structure and easy assembly.

DETAILED DESCRIPTION OF THE PREFERRED EMBODIMENTS

The present invention will be more clear from the following description when viewed together with the accompanying drawings, which show, for the purpose of illustrations only, the preferred embodiment in accordance with the present invention.

Figure 1:
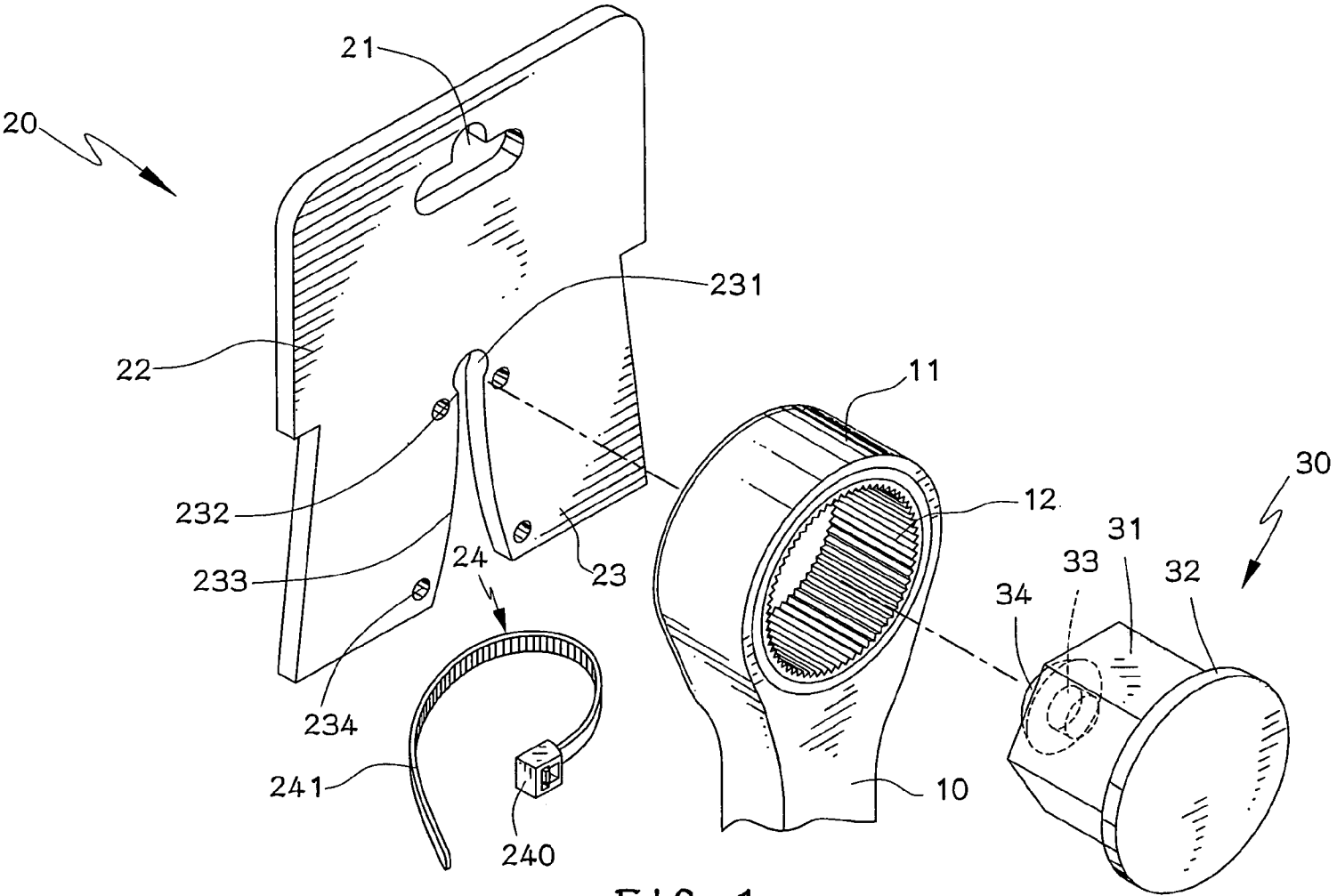
FIG. 1 is an exploded view of a simplified rotatable anti-theft tool rack in accordance with the present invention.
Figure 2:
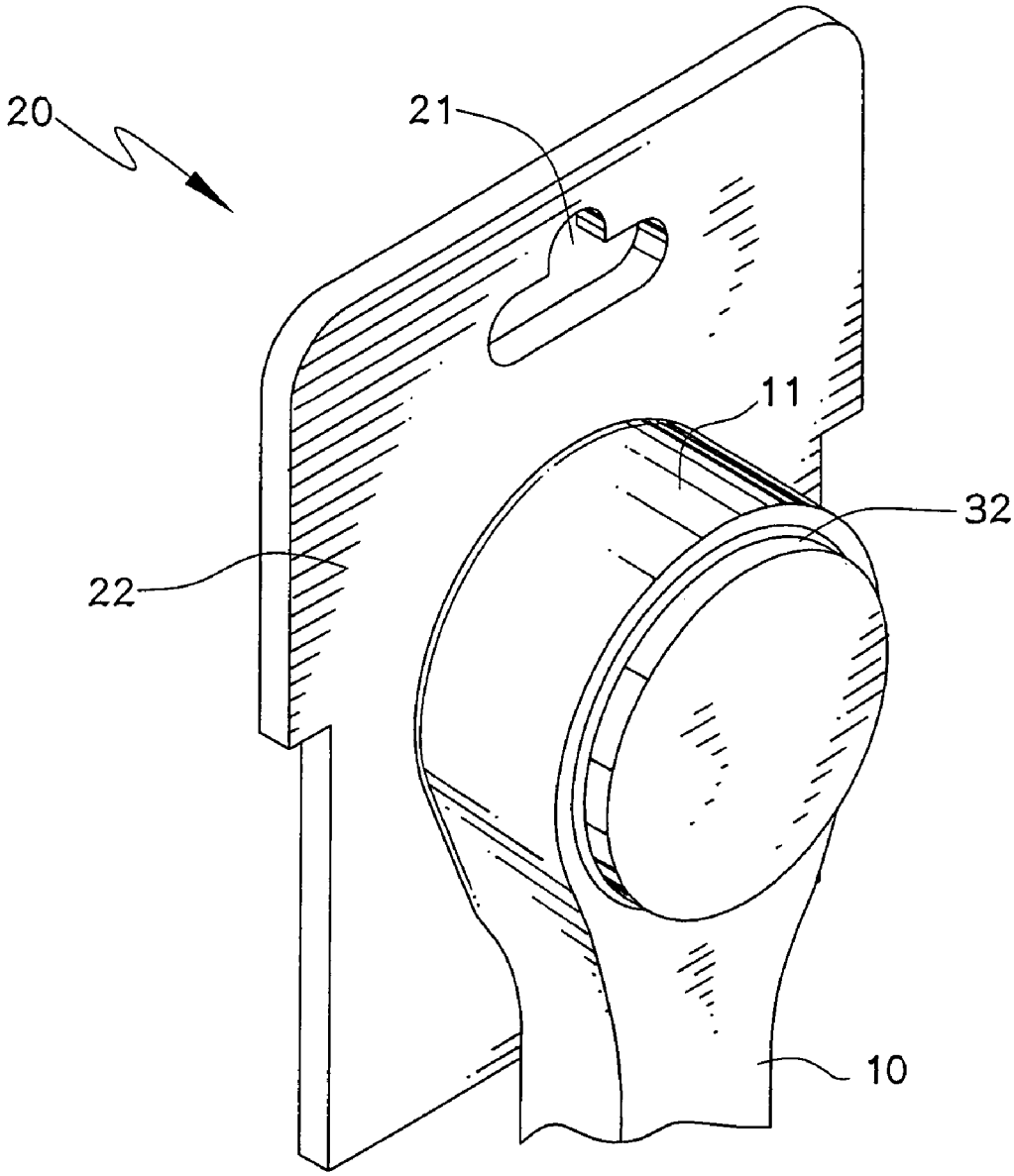
FIG. 2 is an assembly view of the simplified rotatable anti-theft tool rack in accordance with the present invention.
Figure 3:
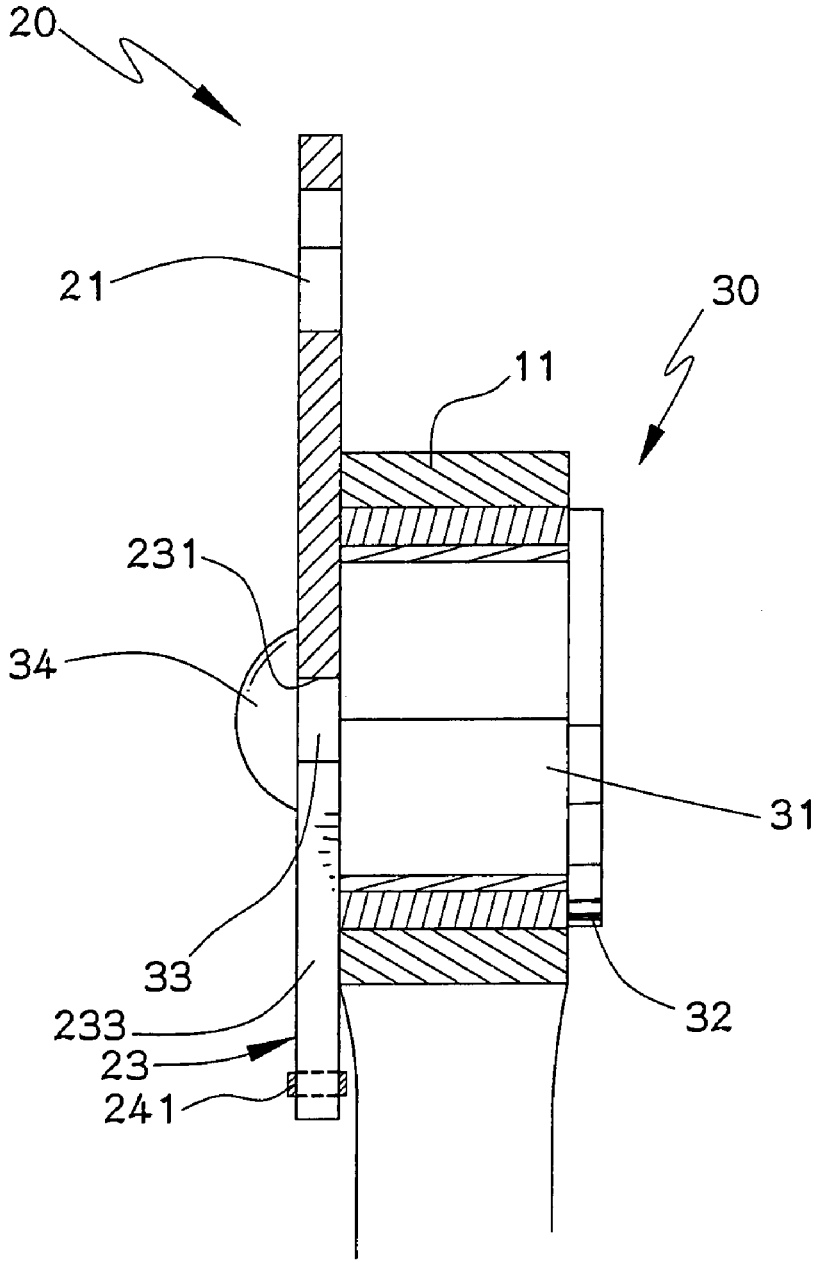
FIG. 3 is an assembly cross sectional view of the simplified rotatable anti-theft tool rack in accordance with the present invention.

Referring to FIGS. 1-3, a simplified rotatable anti-theft tool rack in accordance with a preferred embodiment of the present invention comprises a board-shaped tool rack body 20 and an inserting body 30 that cooperate with each other to position a tool 10. The tool 10 includes a head 11 with a closed receiving portion 12. The tool rack body 20 includes a hanging hole 21 and a displaying portion 22. The featured structures of the present invention are a hanging portion 23 for positioning the tool 10 and the integral inserting body 30 to be inserted in the hanging portion 23.

The hanging portion 23 is formed at the center thereof with a limiting portion 231 used to position the inserting body 30. The limiting portion 231 is a through hole with a gap at one side thereof, which is C-shaped or U-shaped. The gap of the limiting portion is a little smaller than the diameter of the through hole and extended outwards to form a straight shape or an outspread trumpet shape. The narrow portion is a stopping portion 232 which is extended outwards to form a slanted open guiding portion 233, at both sides of the guiding portion 233 are formed fastening portions 234 in the form of through holes for insertion of the inserting end 241 of the strap-shaped fixing element 24 into the fixing end 240, so as to tighten and close the stopping portion 232, thus directly restricting the inserting body 30 within the limiting portion 231.

The inserting body 30 includes an engaging portion 31 of a hexagonal or multangular pattern to be inserted through the receiving portion 12 of the tool 10. One end of the engaging portion 31 is provided with a stopping flange 32 for stopping the outer edge of the receiving portion 12 of the tool 10. The other end of the engaging portion 31 is formed with a neck-shaped inserting portion 33 of a round column body or a polygon body, and the outside diameter of the inserting portion 33 is as large as the inside diameter of the limiting portion 231. At the end of the limiting portion 231 which has inserted through the limiting portion 231 is formed a convex big-diameter check portion 34.

During the assembly, when the fixing element 24 has not been inserted into the fastening portion 234, the inserting body 30 can be directly inserted into the receiving portion 12, and through the outspread guiding portion 233, the inserting portion 33 is pushed to slide along the guiding portion 233 and the stopping portion 232 into the limiting portion 231. Afterwards, the fixing element 24 is inserted through the fastening portion 234 to restrict the inserting portion 33 within the stopping portion 232.

Figure 4:
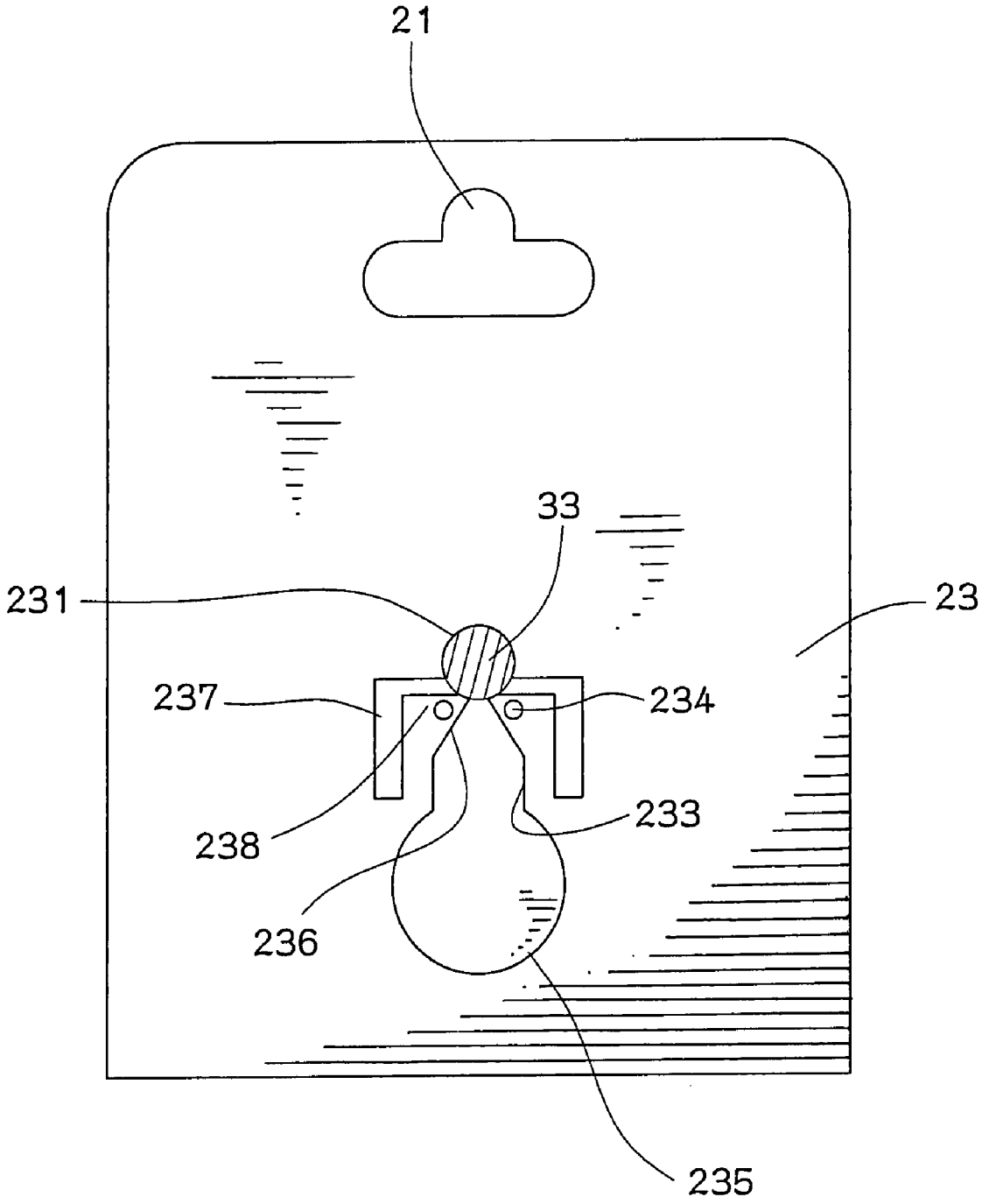
FIG. 4 shows a simplified rotatable anti-theft tool rack with double check portions in accordance with the present invention.
Figure 5:
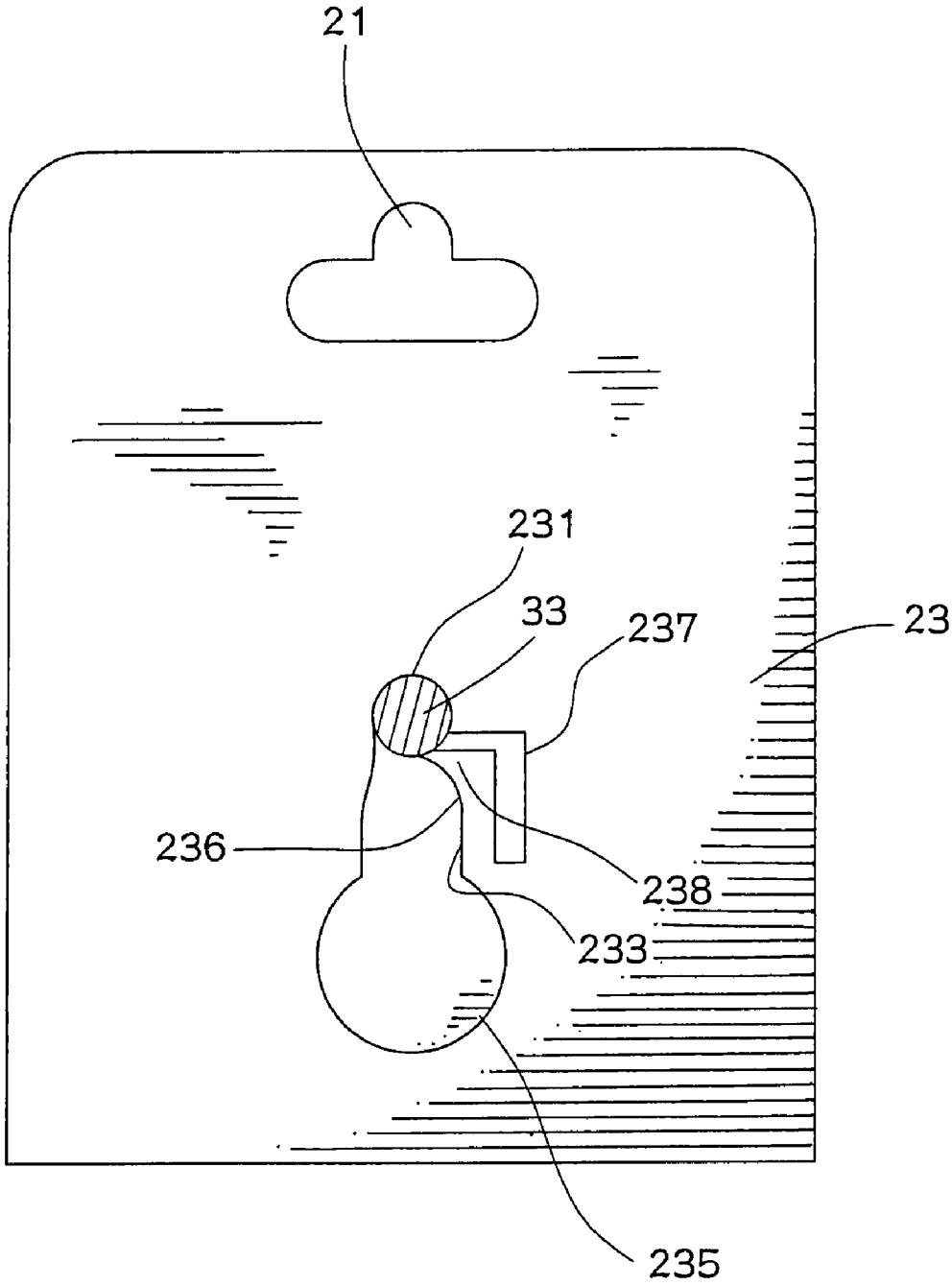
FIG. 5 is a cross sectional view of FIG. 4.

Further referring to FIGS. 4-5, the hanging portion 23 of the tool rack 20 in accordance with another embodiment of the present invention comprises an enlarged hole-shaped receiving portion 235 at the end of the guiding portion 233, and an outwards outspread check portion 236, at the periphery of the check portion 236 is provided an elasticity providing portion 237 in the form of a slot employed to provide the elasticity to the check portion 236. Between the check portion 236 and the elasticity providing portion 237 is formed an elastic returning portion 238. By such arrangements, during the assembly, the big-diameter check portion 34 is initially inserted through the receiving portion 235, then the inserting portion 33 is pushed to slide along the guiding portion 233 and the check portion 236, and push the check portion 236 away and deform the returning portion 238. When the inserting portion 33 goes into the limiting portion 231, the returning portion 238 will make the check portion 236 return to its original position and, so as to close the opening of the limiting portion 231, thus restricting the inserting portion 33 within the limiting portion 231.

Figure 6:
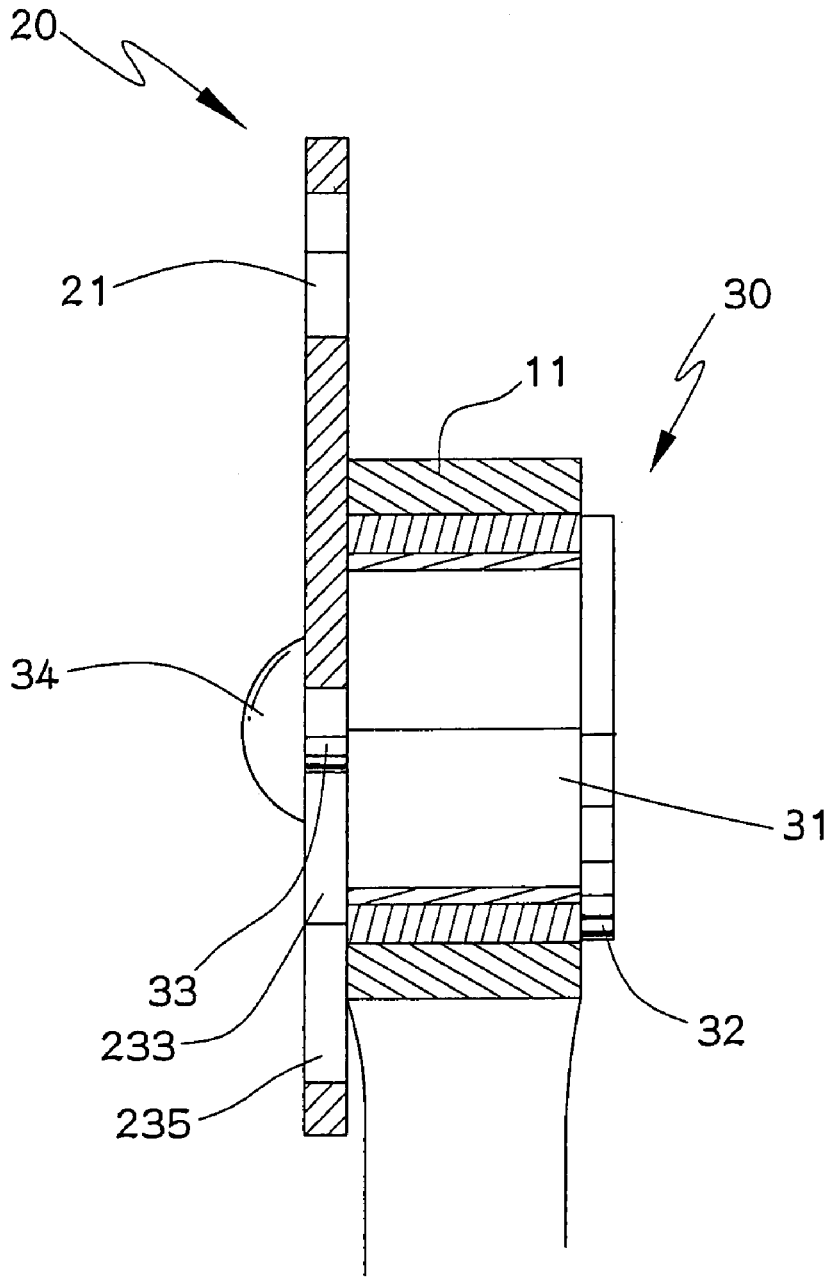
FIG. 6 shows a the simplified rotatable anti-theft tool rack with single check portion in accordance with the present invention.

Further referring to FIG. 6, it is varied from the embodiment of FIG. 4, the check portions 236 of FIGS. 4 and 5 are formed with double locking portions at both sides of the guiding portion respectively. However, FIG. 5 is of a single locking pattern, and only the check portion 236 can extend a relative long distance to limit the inserting portion 33.

Figure 7:
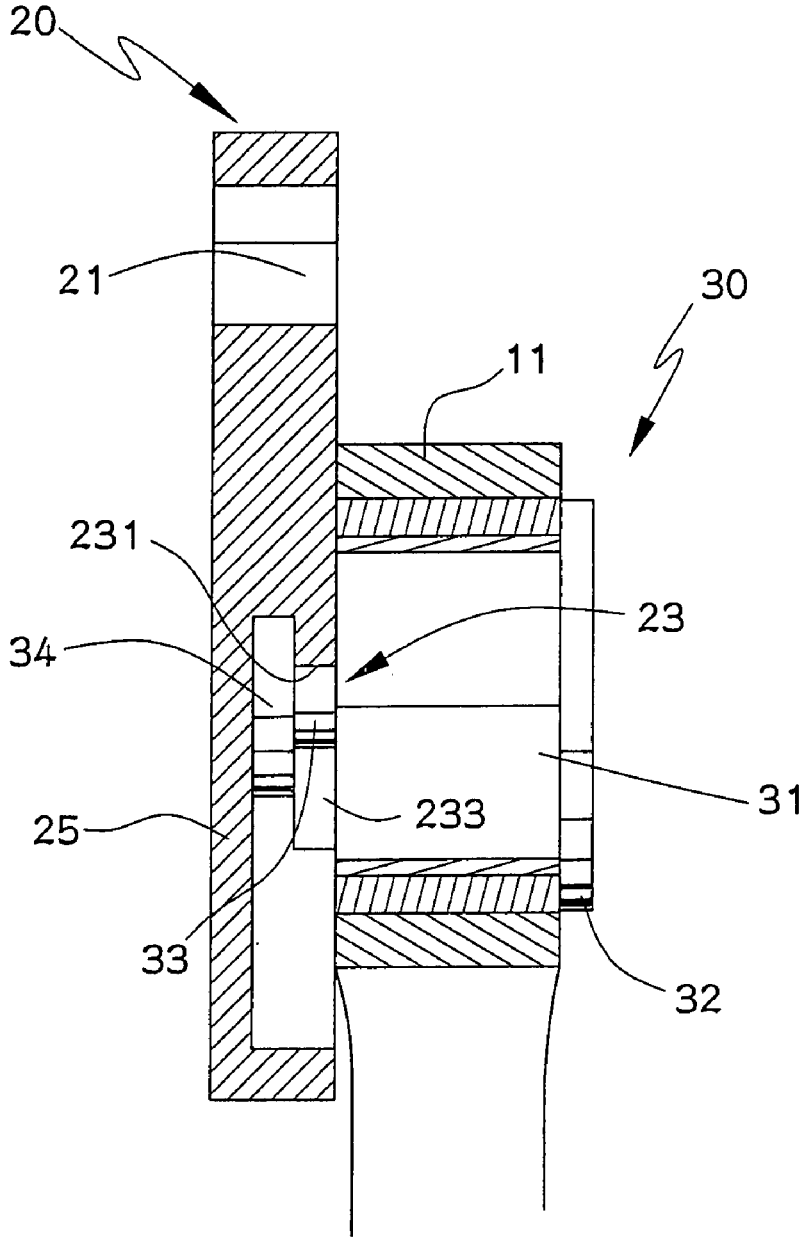
FIG. 7 is a cross sectional view of a half-closed tool rack of FIGS. 4-6 in accordance with the present invention.
Figure 8:
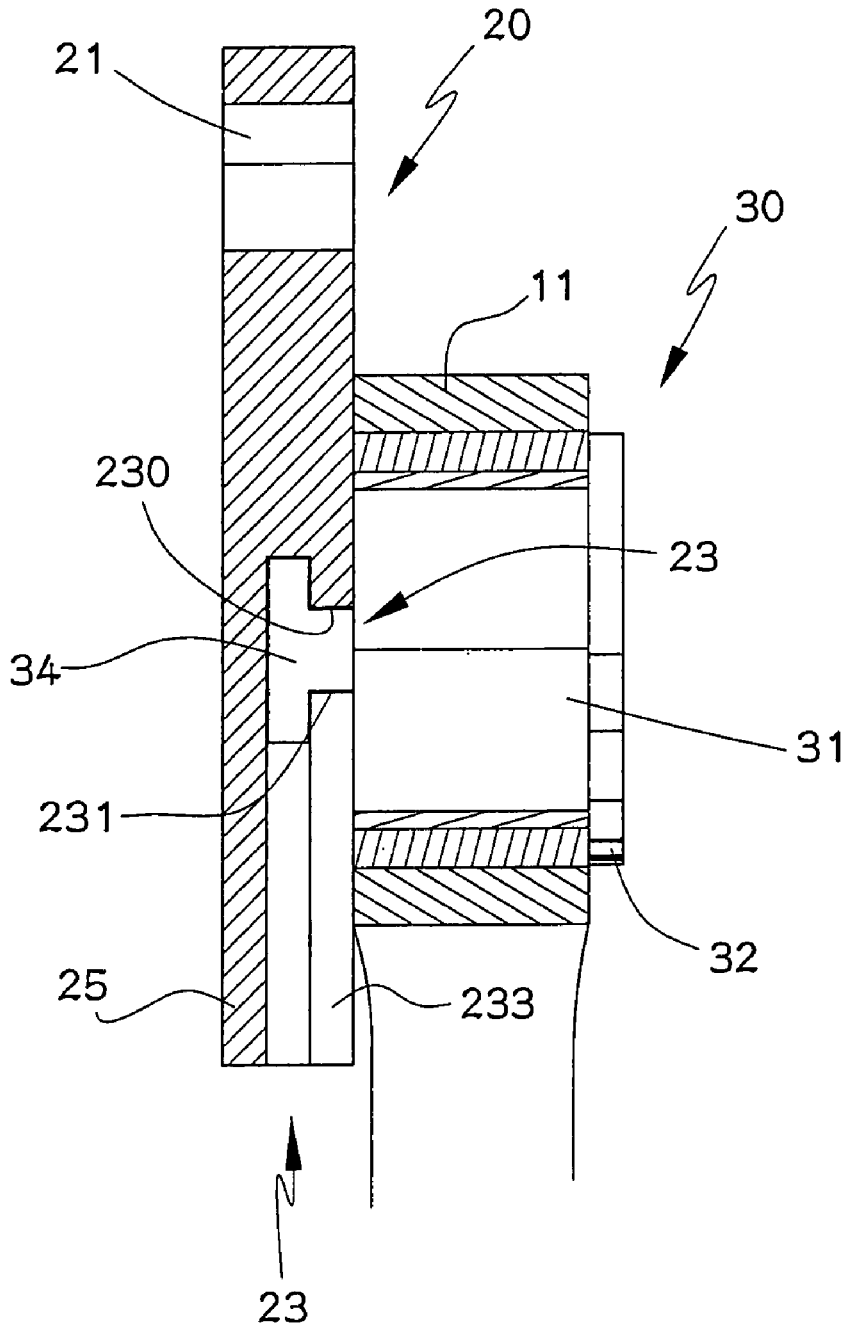
FIG. 8 is a cross sectional view of a half-closed tool rack of FIGS. 1-3 in accordance with the present invention.
Figure 9:
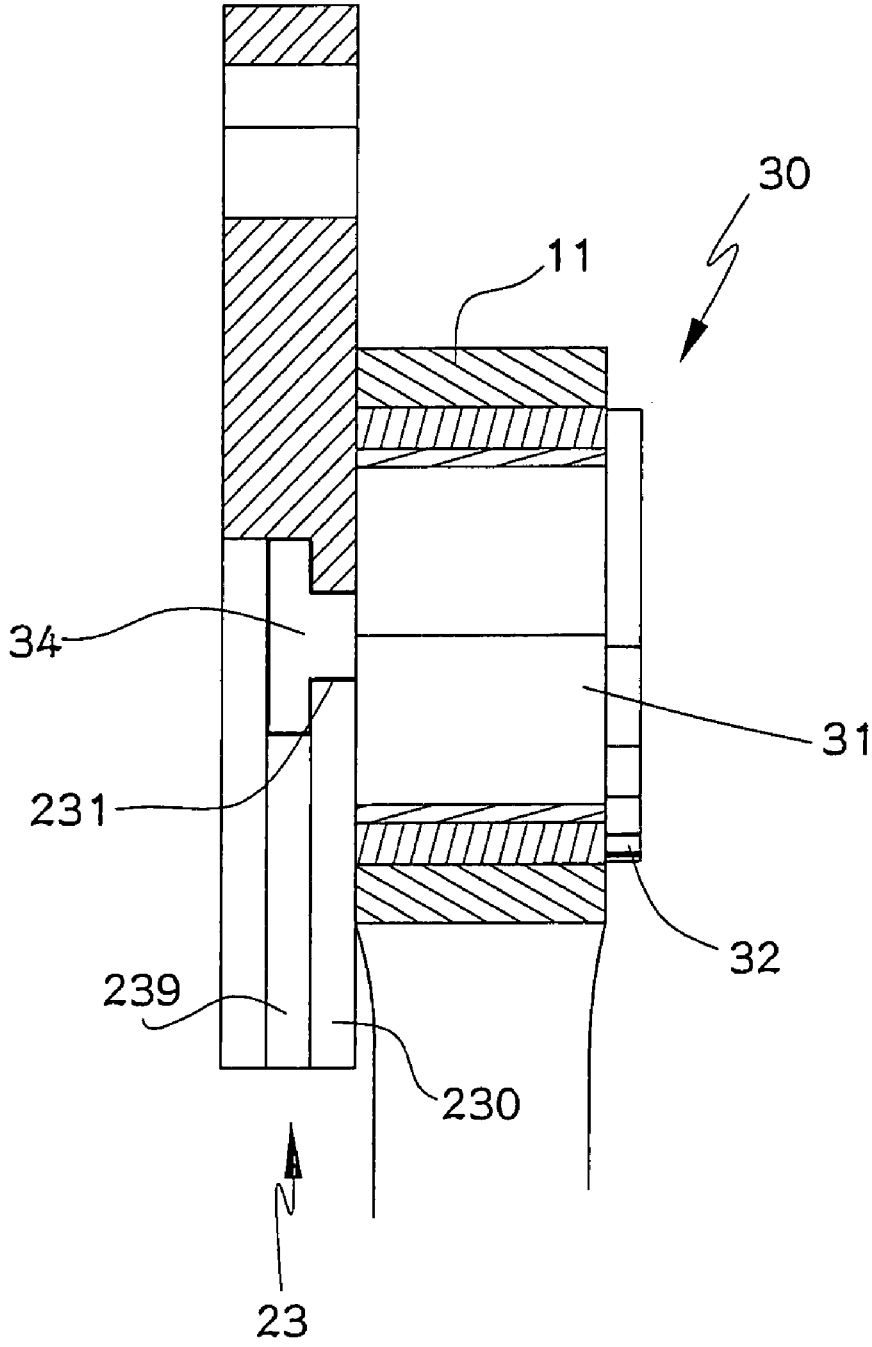
FIG. 9 is a cross sectional view of an opened tool rack of FIGS. 1-3 in accordance with the present invention.
Figure 10:
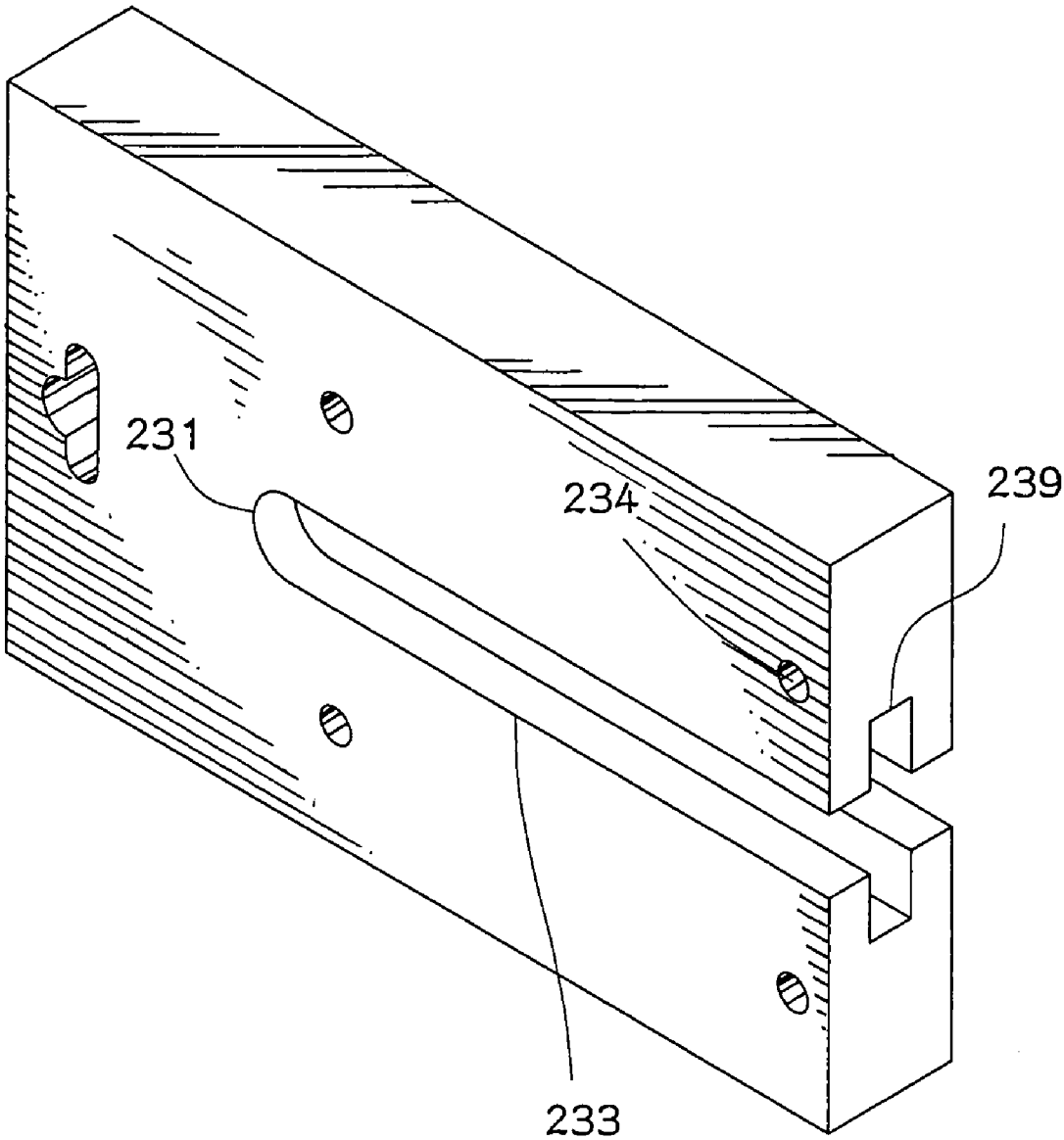
FIG. 10 is a perspective view of the opened tool rack of FIG. 9.

The limiting portion 231 disposed on the hanging portion 23 of the tool rack 20 is a structure penetrating the hanging portion 23, that is to say the check portion 34 of the inserting body 30 protrudes out of the rear surface of the hanging portion 23. In addition, the rear surface of the hanging portion 23 of the tool rack 20 can also be in a closed form, as shown in FIG. 7, increasing the whole thickness of the tool rack 20, or only increasing the rear surface structure of the hanging portion 23 can form a closed stopping back portion 25 on the rear surface of the limiting portion 231, thus preventing the structure of the present invention from being destroyed from the back. Further referring to FIG. 8, the rear surface of the hanging portion 23 of the tool rack 20 is also provided with a stopping back portion 25, the other relevant structures of the limiting portion 231 are as shown in FIGS. 1-3. The check portion 34 of the inserting body 30 is in the form of a flat plate, so that the end of the check portion 34 will not project excessively to cause the interference after inserting through the limiting portion 231. Further referring to FIGS. 9-10, the hanging portion 23 of the tool rack 20 with limiting portion 231 and the like includes a channel-shaped engaging portion 239 disposed in the middle of walls of both sides of the stopping portion 232 and the guiding portion 233, so as to slidably receive the 34 of the inserting body 30, thus also preventing the rear surface of the present invention from being destroyed.

Figure 11:
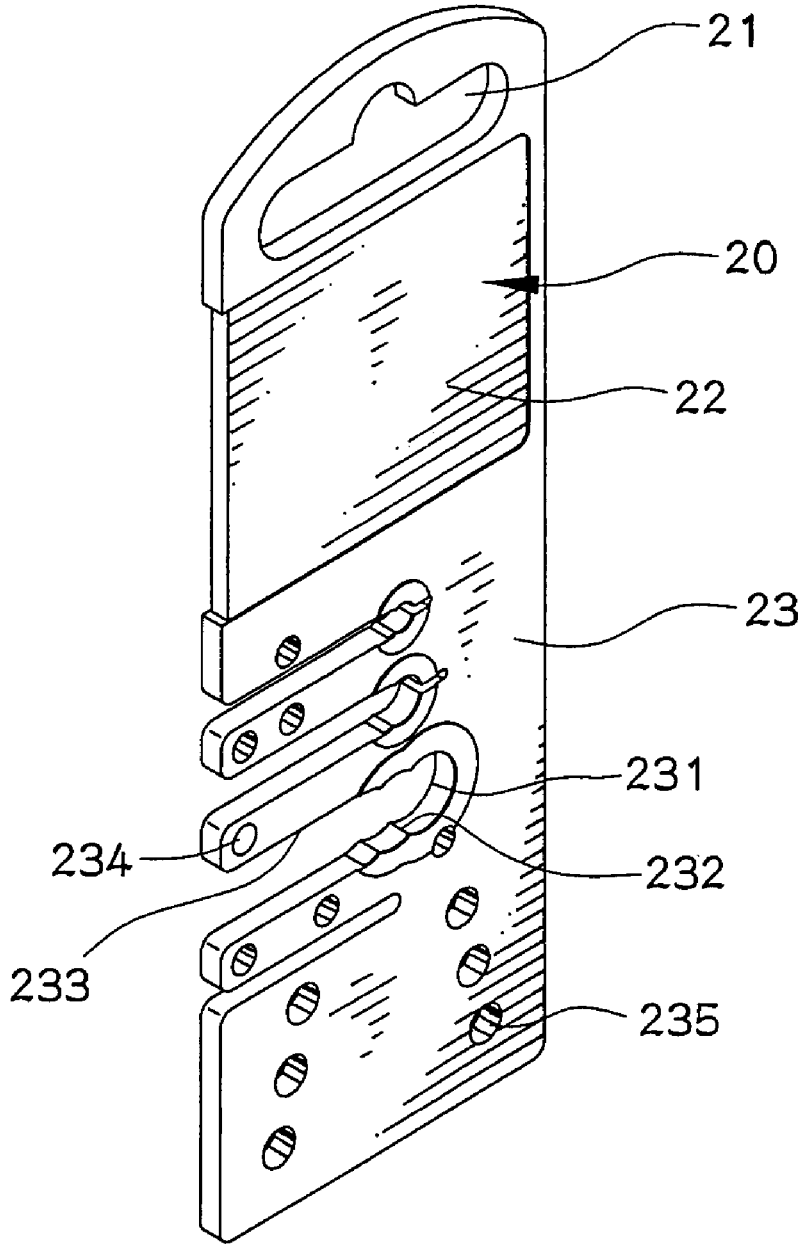
FIG. 11 is a perspective view of another simplified rotatable anti-theft tool rack in accordance with the present invention.

Further referring to FIG. 11, the limiting portions 231 of the hanging portion 231 of the tool rack 20 are formed as a plurality of gaps with different size arranged up and down at one side. One side of each limiting portion 231 is extended to form narrow stopping portion 232, and a guiding portion 233 is extended outwards from the stopping portion 232. At both sides of the guiding portion 233 are formed fastening portions 234 in the form of through holes for the insertion of the strap-shaped fixing element 24, so as to fix the head 11 of the tool 10. The handle of the tool 10 is formed with a plurality of fixing portions 239 in the form of through holes for the insertion of the strap to position the handle.

The abovementioned structure has the following advantages:

1. structure simplification: since the inserting body 30 is integrally formed, the whole of the present invention can be reduced to three components for assembly, thus not only reducing the manufacturing cost, but also reducing the cost and the number of the worker of the assembly.

2. safe anti-theft: the abovementioned structure, especially the fastening portion 234, limiting portion 231, check portion 236 and the like can be disposed in the coverage of check portion 34 of the inserting portion, so as to prevent the destroying or returning operation after the whole assembly, thus achieving the safe anti-theft effect.

3. quick assembly: especially for the structures of the second, third embodiments, the check portion 34 of the inserting body 30 can be directly inserted through the receiving portion 12 of the tool 10, then the inserting portion 33 will go through the guiding portion 233 into the limiting portion 231 and be restricted in the limiting portion 231 without other assembly structures, thus achieving the objective of quick assembly.

While we have shown and described various embodiments in accordance with the present invention, it is clear to those skilled in the art that further embodiments may be made without departing from the scope of the present invention.

What is claimed is:

1. A combination of a simplified rotatable anti-theft tool rack and a tool, the combination comprising:

the tool including a head, a handle extending from the head and a receiving portion formed on the head;

a tool rack body adapted for positioning the tool and including a hanging portion serving to hang the tool;

wherein the hanging portion includes at least one limiting portion and a guiding portion formed from a gap of each limiting portion and opened to a side of the tool rack body opposite to the related limiting portion, with the at least one limiting portion and the guiding portion penetrating the tool rack body;

an inserting body adapted to position the tool onto the hanging portion of the tool rack body and inserted through the receiving portion of the tool; a strap-shaped fixing element having an inserting end and a fixing end and adapted for positioning the handle of the tool onto the tool rack body, with the inserting end of the strap-shaped fixing element inserted two sides of the guiding portion and winding the handle of the tool as to tighten and close the guiding portion, with cooperation of the strap-shaped fixing element and the guiding portion applicable to various sizes of tools.

2. The combination as claimed in claim 1, wherein the at least one limiting portion consists of a through hole with the gap formed on periphery of the through hole and adjacent to the guiding portion, with the gap being a slightly smaller than a diameter of the through hole, with a stopping portion defined at the gap of the limiting portion and communicating with the limiting portion and the guiding portion.

3. The combination as claimed in claim 1, wherein the inserting body includes an engaging portion to be inserted through the receiving portion of the tool, one end of the engaging portion is formed with an outwards-protruding stopping flange, the other end of the engaging portion is formed with an inserting portion, an outside diameter of the inserting portion is as large as an inside diameter of the limiting portion, one end of the inserting portion which has inserted through the limiting portion is formed with a big-diameter check portion.

4. The combination as claimed in claim 3, wherein the inserting portion of the engaging portion of the inserting body is a neck-shaped structure.

5. The combination as claimed in claim 3, wherein the inserting portion of the engaging portion of the inserting body is of a columnar pattern or a polygon pattern, the outside diameter of inserting portion is as large as the inside diameter of the limiting portion, a length of the inserting portion is equal to a thickness of the limiting portion.

6. The combination as claimed in claim 1 further comprising a hanging hole formed on the tool rack body for hanging the simplified rotatable anti-theft tool rack onto walls.

7. The combination as claimed in claim 1 wherein the at least one limiting portions of the hanging portion of the tool rack are formed as a plurality of gaps with different size arranged up and down at one side, with various sizes of tools able to be fixed on the tool rack.

8. A combination of a simplified rotatable anti-theft tool rack, an inserting body and a tool, the combination comprising:

the tool including a head, a handle extending from the head and a receiving portion formed on the head;

a tool rack body including a hanging portion serving to hang the tool, with the hanging portion including a limiting portion used to receive and restrict the inserting body, a guiding portion formed from a gap of the limiting portion and opened to a side of the tool rack body opposite to the limiting portion, with the limiting portion and the guiding portion penetrating the tool rack body, and a stopping back portion being formed at a rear surface of the hanging portion;

wherein the inserting body includes an engaging portion to be inserted through the receiving portion of the tool, one end of the engaging portion is formed with an outwards-protruding stopping flange, the other end of the engaging portion is formed with an inserting portion, an outside diameter of the inserting portion is as large as an inside diameter of the limiting portion, one end of the inserting portion which has inserted through the limiting portion is formed with a big-diameter check portion.

9. The combination as claimed in claim 8 further comprising a hanging hole formed on the tool rack body for hanging the simplified rotatable anti-theft tool rack onto walls.

10. The combination as claimed in claim 8 wherein the at least one limiting portions of the hanging portion of the tool rack are formed as a plurality of gaps with different size arranged up and down at one side, with various sizes of tools able to be fixed on the tool rack.

* * * * *